US005755488A

United States Patent [19]

Beda et al.

[11] Patent Number: 5,755,488

[45] Date of Patent: May 26, 1998

[54] CHAIR WITH ADJUSTABLE SEAT

[75] Inventors: Gregory S. Beda, Comstock Park; Daniel P. Beemer, Wyoming; Diane L. Ellis, Muskegon; Michelle R. Johnson, Grand Rapids; Charles P. Roossien, Wyoming; James P. Steffens, Hopkins, all of Mich.

[73] Assignee: Steelcase Inc., Grand Rapids, Mich.

[21] Appl. No.: 813,806

[22] Filed: Mar. 6, 1997

[51] Int. Cl.[6] ..... A47C 1/02

[52] U.S. Cl. ..... 297/337; 297/DIG. 2

[58] Field of Search ..... 297/337, 311, 297/284.1, 284.11, DIG. 2, 354.12, 451.11, 357, 317, 318, 341, 342, 343, 244.13, 344.14, 411.35, 215.14, 338

[56] References Cited

U.S. PATENT DOCUMENTS

| | | | |
|---|---|---|---|
| 134,627 | 1/1873 | Barney | 297/337 X |
| 942,818 | 12/1909 | Flindall | 297/317 |
| 1,621,520 | 3/1927 | Snyder . | |
| 1,769,242 | 7/1930 | Toncray | 297/357 X |
| 1,922,418 | 8/1933 | Conant . | |
| 1,987,851 | 1/1935 | Holman | 297/337 X |
| 2,021,120 | 11/1935 | Wilkens | 297/317 |
| 2,855,026 | 10/1958 | Simons et al. . | |
| 2,988,398 | 6/1961 | Hamilton . | |
| 3,090,647 | 5/1963 | Moore . | |
| 3,144,270 | 8/1964 | Bilancia . | |
| 3,235,308 | 2/1966 | Conner . | |
| 3,408,106 | 10/1968 | Bolling et al. | 297/452.51 X |
| 3,511,533 | 5/1970 | Drabert . | |
| 3,982,785 | 9/1976 | Ambasz . | |
| 4,054,318 | 10/1977 | Costin . | |
| 4,084,850 | 4/1978 | Ambasz . | |
| 4,560,200 | 12/1985 | Giannelli et al. | 297/344.13 X |
| 4,648,654 | 3/1987 | Voss . | |
| 4,648,656 | 3/1987 | Kimura . | |
| 4,687,251 | 8/1987 | Kazaoka et al. . | |
| 4,796,951 | 1/1989 | Tamura et al. . | |
| 5,035,466 | 7/1991 | Mathews et al. . | |
| 5,171,062 | 12/1992 | Courtois . | |
| 5,370,444 | 12/1994 | Stulik . | |
| 5,390,978 | 2/1995 | Janisch . | |
| 5,431,360 | 7/1995 | Yu . | |
| 5,520,438 | 5/1996 | Stulik . | |

*Primary Examiner*—Milton Nelson, Jr.
*Attorney, Agent, or Firm*—Price, Heneveld, Cooper, DeWitt & Litton

[57] ABSTRACT

A chair including a seat support, a seat movably supported on the seat support for movement between a raised position permitting sliding depth adjustment of the seat and a lowered position preventing adjustment, and a detent device for securely holding the seat in the raised position while the seat is being slidable adjusted. A rack is formed integrally on or attached to the bottom of the seat shell. The detent device includes a seat support bracket attached to a top of a chair control, and a pair of moldings attached to opposite sides of the bracket. The moldings each include upwardly facing teeth for selectively engaging the racks to hold the seat in a selected, depth adjusted position. A resilient finger on each molding is adapted to engage a ridge on the seat shell for selectively holding the seat in either a raised position or in a lowered position. The seat shell engages mating structure on the seat support bracket to permit guided sliding of the seat when in the raised position for depth adjustment, and to prevent cocking and twisting of the seat shell during the depth adjustment.

20 Claims, 7 Drawing Sheets

Fig. 7
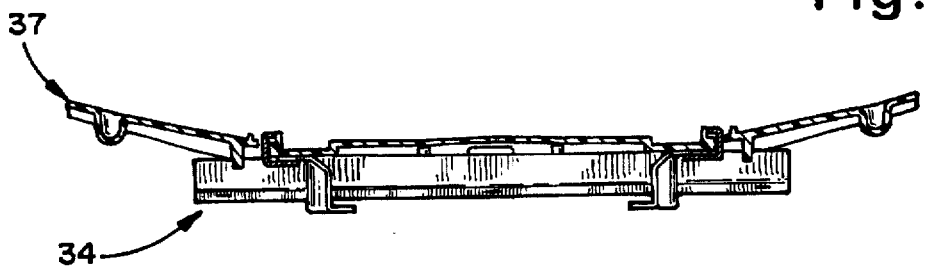
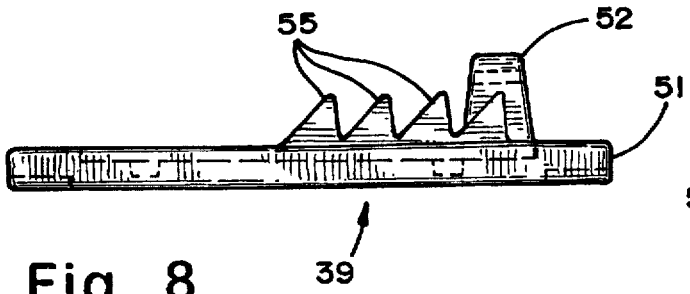
Fig. 8
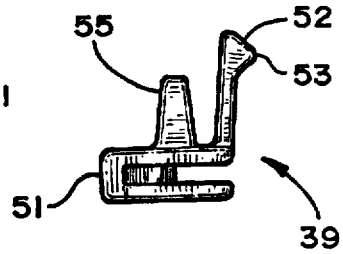
Fig. 9
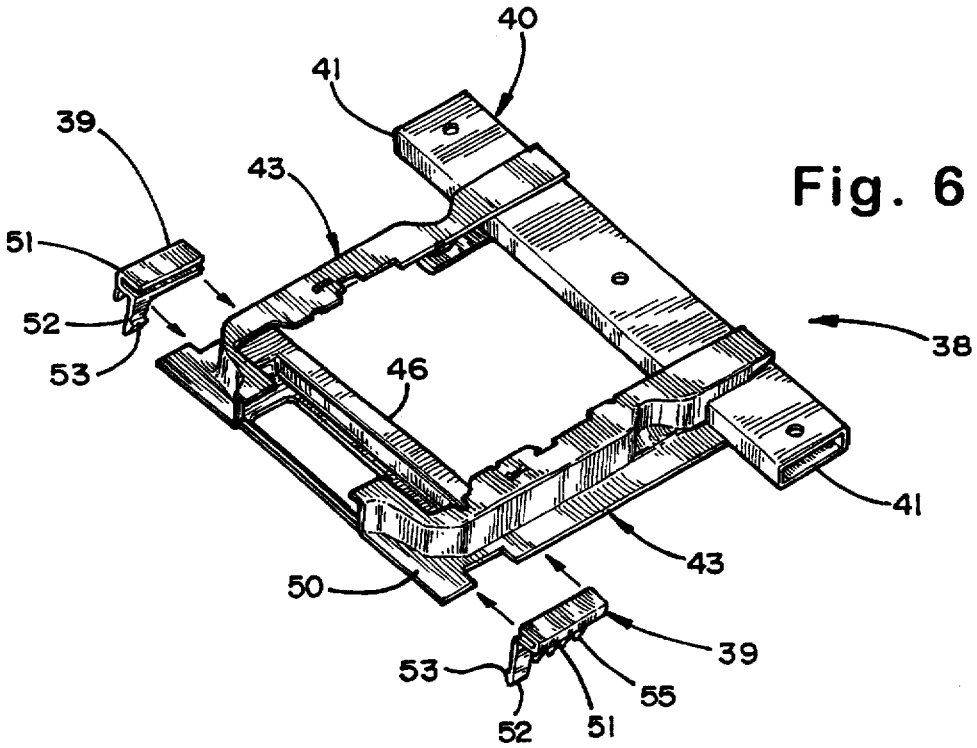
Fig. 6

CHAIR WITH ADJUSTABLE SEAT

BACKGROUND OF THE INVENTION

The present invention relates to a chair having a depth-adjustable seat and structure configured to maximize ease of use and manufactureability.

Task chairs are often made adjustable to accommodate people having different physiques. However, the hardware necessary to allow adjustment can cause the chair to be expensive to manufacture. Further, adjustable chairs are often not user friendly, but instead are cumbersome or awkward to adjust. Compounding this problem is the fact that many users are not mechanically inclined, such that they become frustrated when trying to adjust the chair. Also, the hardware may cause the chair to have a thick, unacceptably bulky appearance. Thus, an inexpensive adjustable chair is desired that is easy to operate/adjust and that has a relatively simple, low profile mechanism.

SUMMARY OF THE INVENTION

In one aspect, the present invention includes an adjustable chair having a seat support, and a seat movably supported on the seat support for movement between a raised position permitting sliding/depth adjustment of the seat and a lowered position preventing adjustment. A device is provided for securely holding the seat in the raised position while the seat is being slidable adjusted.

In another aspect, the present invention includes a chair having a reclineable back, a seat including a molded shell, and a control for movably supporting the back. The chair further includes a bracket attached to the control for adjustably supporting the seat, a rack formed on one of the bracket and the molded shell, and teeth on the other of the bracket and the molded shell for selectively engaging the rack.

In yet another aspect, the present invention includes a chair having a base, and a seat support bracket including parallel opposing members having a forward end and a rearward end. A molding is attached to each of the members generally at one of the forward and rearward ends. A seat shell is provided that includes teeth constructed to selectively engage the molding to hold the seat shell in different seat-depth-adjusted positions, and further that includes a portion spaced from the teeth constructed to slidable engage the support bracket when the teeth are disengaged from the molding, and still further that includes a detent device for holding the seat shell in a raised teeth-disengaged position with the teeth disengaged from the molding so that the seat shell is readily adjustable.

These and other features and advantages of the present invention will be further understood and appreciated by those skilled in the art by reference to the following specification, claims, and appended drawings.

DESCRIPTION OF DRAWINGS

FIG. 6 is an exploded perspective view of the top bracket and toothed moldings attached thereto;

FIG. 7 is a front cross-sectional view of the seat shell attached to the top bracket;

FIGS. 8 and 9 are side and front views of the toothed molding which attaches to the top bracket shown in FIG. 21;

DETAILED DESCRIPTION OF PREFERRED EMBODIMENT

For purposes of description herein, the terms "upper", "lower", "right", "left", "rear", "front", "vertical", "horizontal", and derivatives thereof shall relate to the invention as oriented relative to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
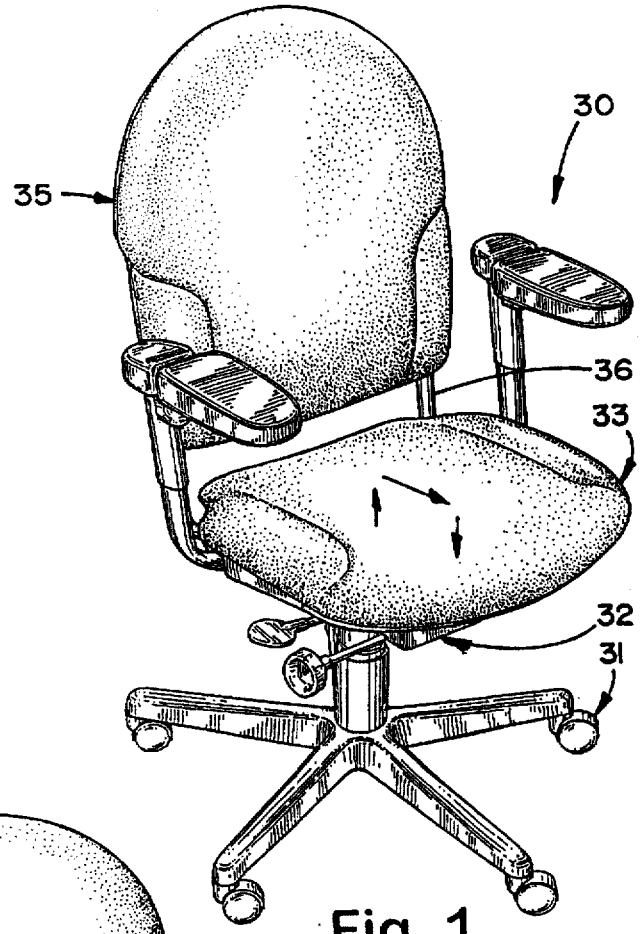
FIG. 1 is a perspective view of a chair embodying the present invention.
Figure 2:
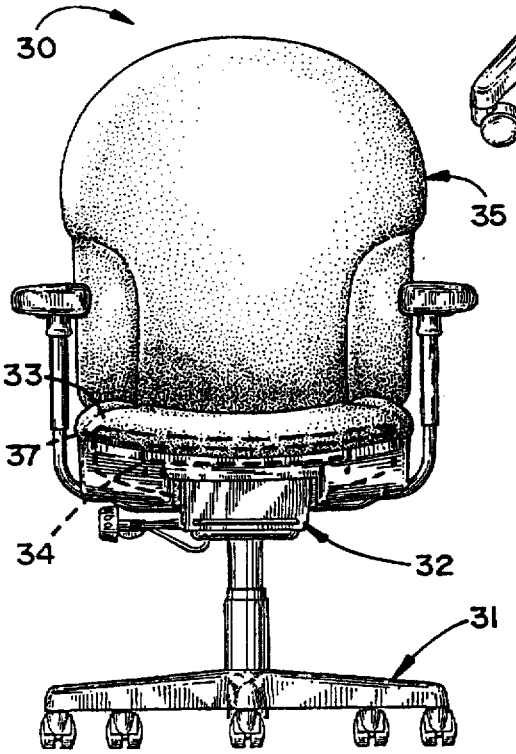
FIGS. 2 and 3 are front and side views of the chair shown in FIG. 1.
Figure 13:
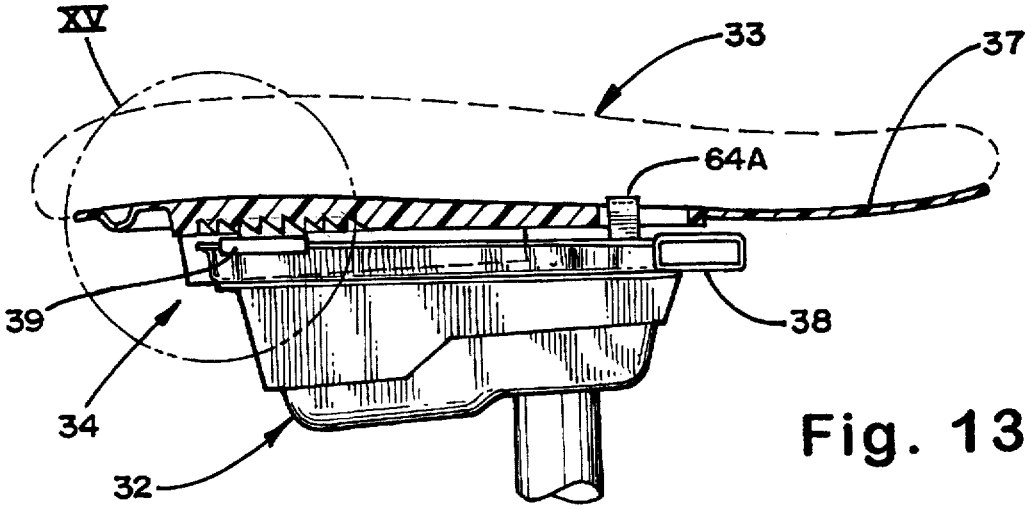
FIGS. 13 and 14 are side cross sections of the chair control and seat, showing the seat shell in two different lowered positions on the seat support.
Figure 14:
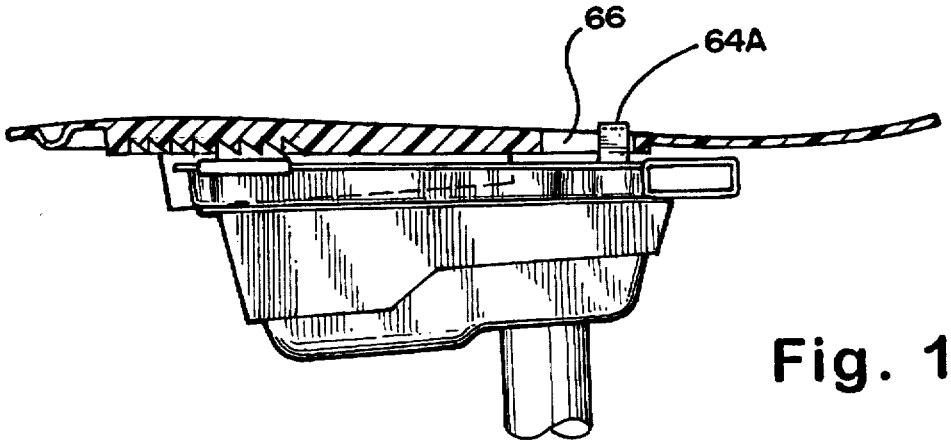
Figure 15:
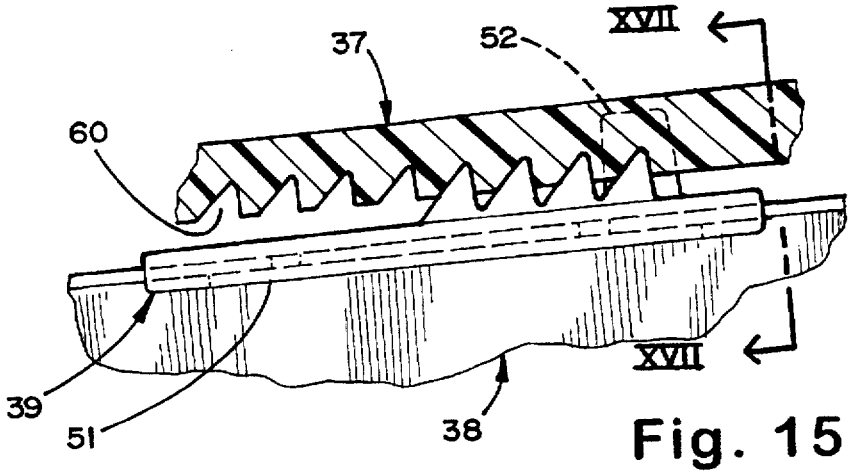
FIG. 15 is an enlarged fragmentary cross section of the circled area XV in FIG. 13, showing the seat shell in a lowered position with the molded-in rack on the seat shell engaging the teeth on the bracket-attached molding.
Figure 16:
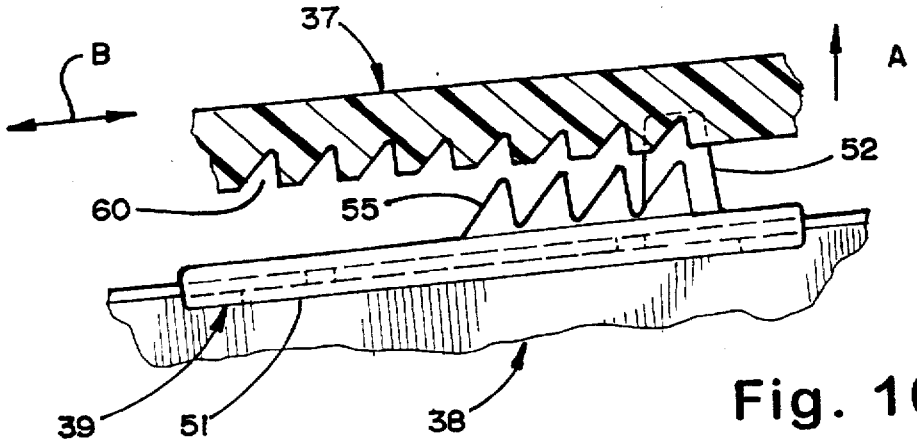
FIG. 16 is a fragmentary cross section similar to FIG. 15, but showing the seat shell raised so that the rack is disengaged from the teeth on the bracket-attached molding.
Figure 17:
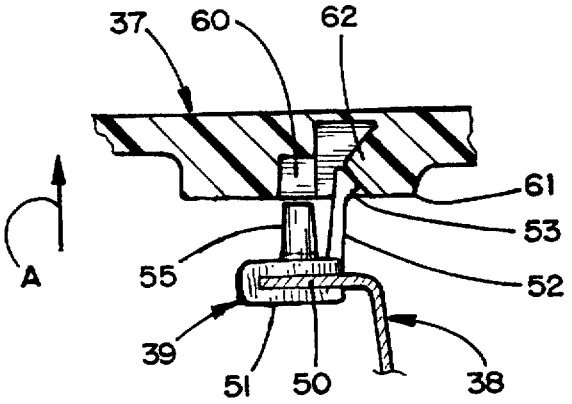
FIG. 17 is a fragmentary cross section taken along the line XVII in FIG. 15, showing the seat shell in a raised position with the spring finger on the bracket-attached molding engaging the seat shell to hold the seat shell in the raised position.
Figure 18:
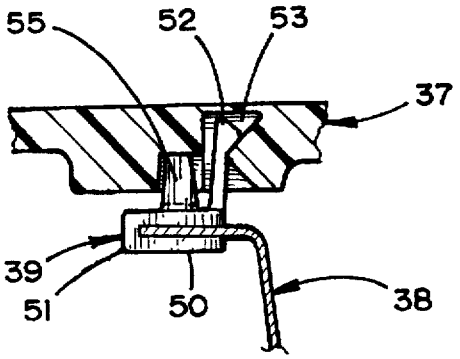
FIG. 18 is a fragmentary cross section similar to FIG. 17, but showing the seat shell lowered so that the spring finger is frictionally engaged with the seat shell to hold the seat shell in the lowered position.
Figure 19:
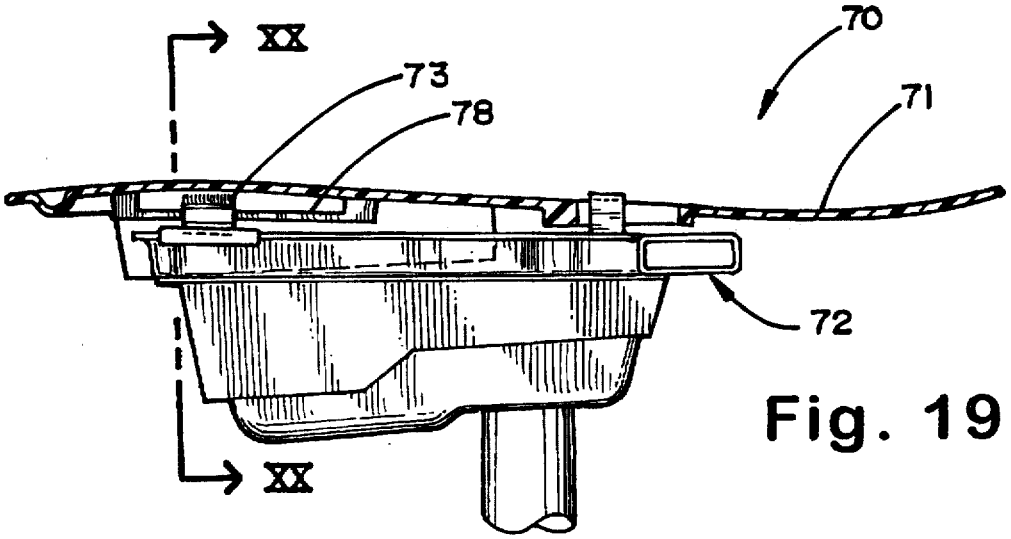
FIG. 19 is a fragmentary, side cross section of a modified seat construction including a modified seat shell, a modified seat support bracket, and an over-center leaf spring for holding the seat shell in either a raised slidable position or a lowered locked position.

A chair 30 (FIG. 1) embodying the present invention includes base 31 and a synchrotilt control 32 attached to the base 31. A back 35 is operably supported on the synchrotilt control 32 by back upright 36. A seat 33 including a seat shell 37 (FIG. 13) is operably supported on the synchrotilt control 32 by a depth adjustment mechanism 34. Depth adjustment mechanism 34 includes a top bracket 38 attached to a top of the control 32 and further includes a pair of moldings 39 attached to the bracket 38 (FIG. 19) for engaging the seat 33. The depth adjustment mechanism 34 (FIGS. 13 and 14) includes a detent device constructed to releasably engage mating structure on the bottom of the seat shell 37 to selectively hold the seat 33 in a depth-adjusted lowered position (FIGS. 13–15 and 18), and is also constructed to hold the seat 33 in a depth-adjustable raised position (FIGS. 14, 16 and 17) that allows sliding movement of the seat 33 on the bracket for depth adjustment.

Figure 4:
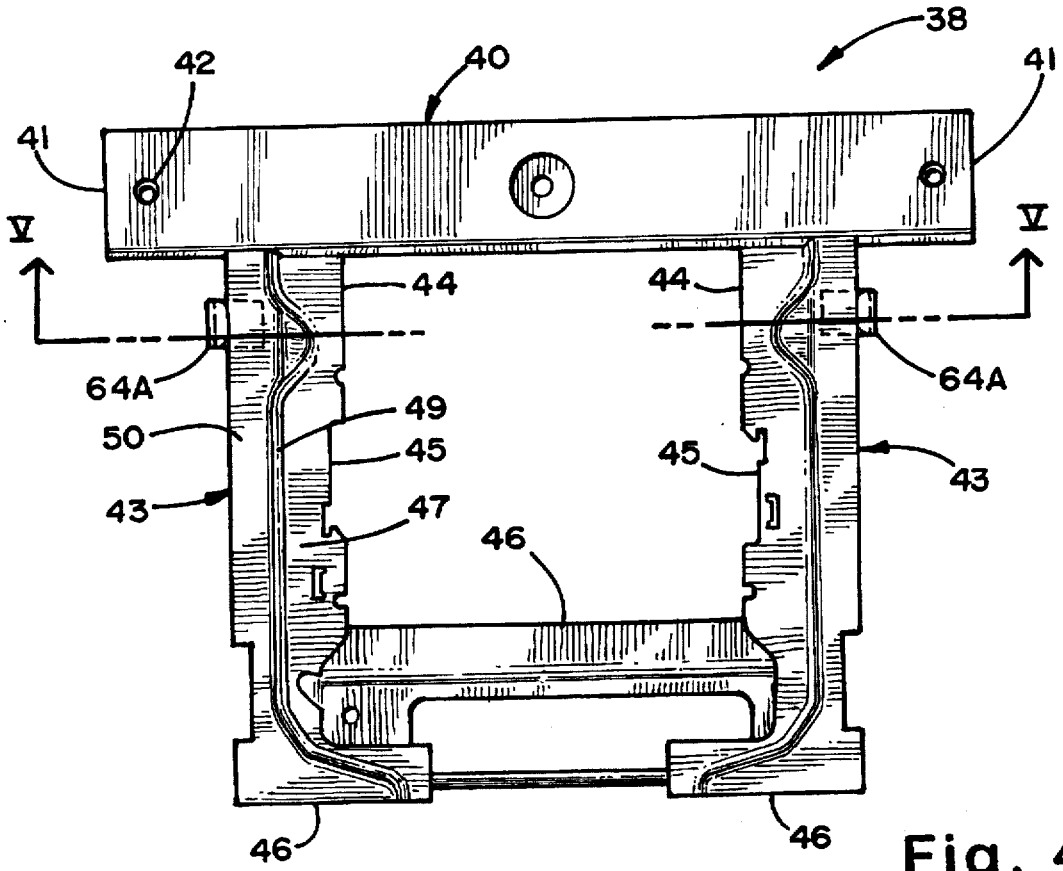
FIGS. 4 and 5 are top and front views of the top bracket which attaches to the control shown in FIGS. 2 and 3.
Figure 5:
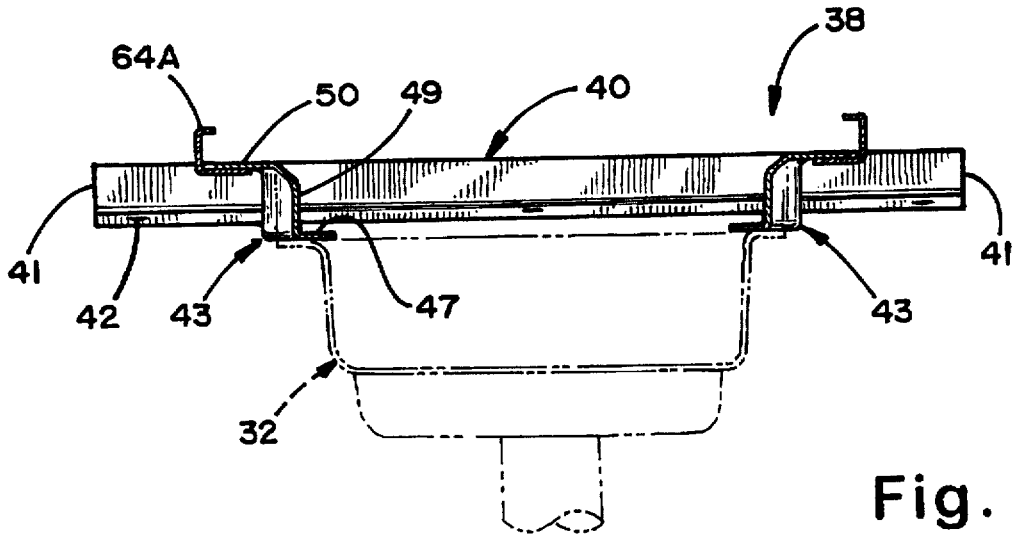

Top bracket 38 (FIGS. 4–6) includes a rectangular tube 40 that extends side-to-side of the chair 30. The tube 40 includes open ends 41 for receiving chair arms (not specifically shown in FIGS. 4 and 5) and attachment structure such as hole 42 for receiving a fastener. A pair of bracket legs 43 are welded to tube 40, and extend forwardly from tube 40. The bracket legs 43 are spaced apart and are generally mirror images of each other. Each leg 43 includes a rear end 44 configured for attachment to tube 40, a center section 45 that is generally Z-shaped in cross section, and a front end 46 that is formed inwardly. A cross brace 46 is used to connect the front of legs 43 if desired. The Z-shaped cross section of center section 45 includes a bottom flange 47 with apertures for receiving screws for attachment to the top of chair control 32. The Z-shaped cross section further includes a relatively flat middle flange 49 adapted to slidingly engage a flat rib on seat shell 37 such that it acts as a guide for depth adjustment of the seat 33. The Z-shaped cross section still further includes a top flange 50 providing an attachment structure for receiving molding 39.

Moldings 39 (FIGS. 8, 9 and also FIG. 6, which is a bottom view) are mirror images of each other, and are constructed to attach to bracket legs 43 in opposing relation near the front ends 46 of legs 43 (FIG. 6). Moldings 39 each include an elongated C-shaped bottom section 51 adapted to mateably engage the flange 50. The section 51 can be attached with screws or can be constructed to frictionally or snappingly attach. A resiliently flexible finger 52 extends upwardly from bottom section 51. The finger 52 includes an enlarged end 53 forming a detent bump for frictionally engaging a mating detent-forming ridge on the seat shell 37. (See FIGS. 17 and 18.) Finger 52 is located along one side and end of the bottom section 51. Several saw-shaped teeth 55 are formed centrally on the top of C-shaped bottom section 51. It is contemplated that teeth 55 can be different shapes, and that more or less teeth can be used if desired. Preferably, the teeth are shaped with a pointed top to assure that the seat 33 can be to easily moved to the lowered position in spite of some misalignment. The teeth 55 are spaced slightly from finger 52 so that finger 52 can flex without restriction.

Figure 10:
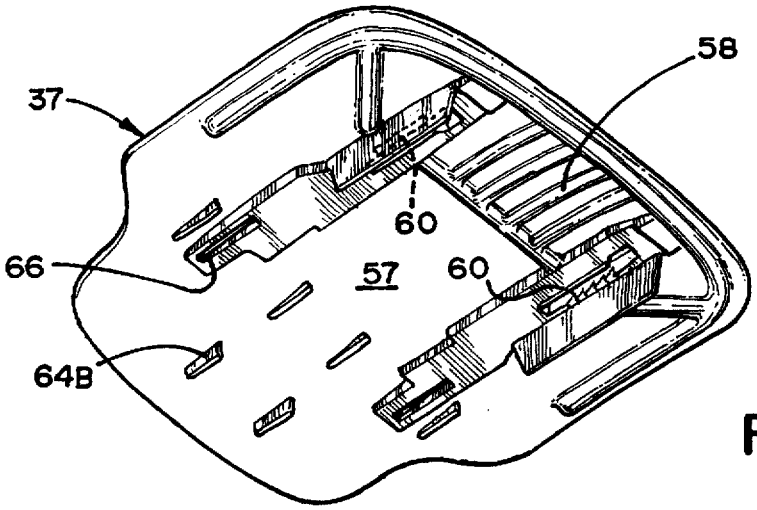
FIGS. 10 and 11 are perspective and bottom views of the seat shell shown in FIG. 2–3.
Figure 11:
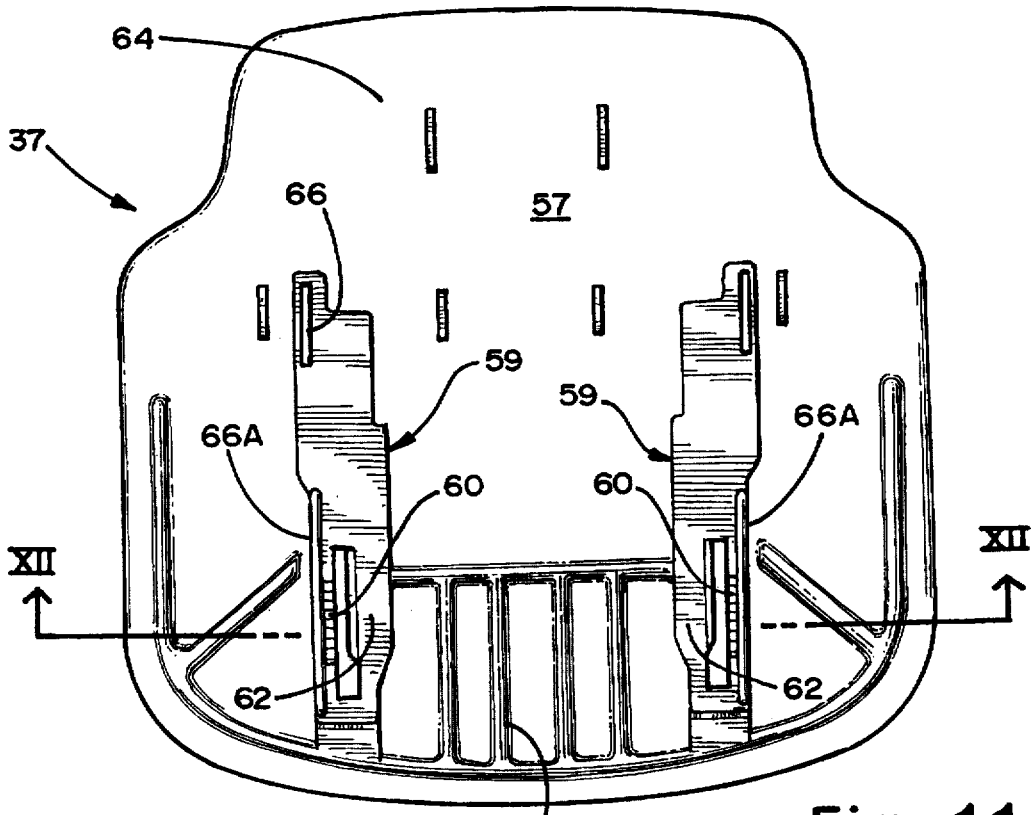
Figure 12:
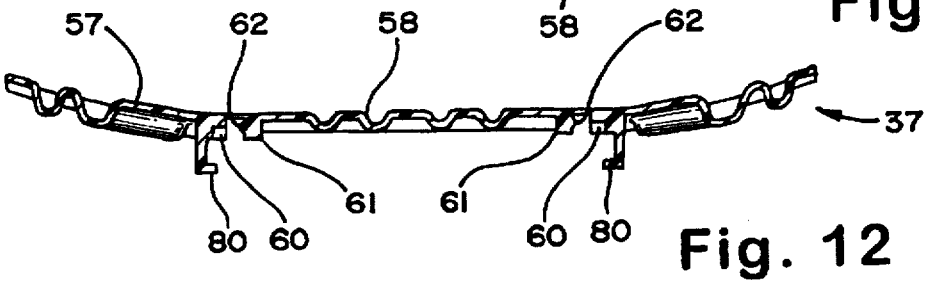
FIG. 12 is a cross section along the line XII—XII in FIG. 11.

The illustrated seat shell 37 (FIGS. 10–12) is generally pan shaped, and is constructed to provide a desired amount of support for a seat cushion and for attachment of fabric around the seat cushion. More specifically, the shell 37 includes a relatively flat panel 57 with ribs, apertures, tabs, and depressions 58 formed therein to provide a desired amount of flexibility to the seat shell 37 and to provide structure for attachment of items to the seat shell. The illustrated depth adjustment mechanism 34 includes spaced apart opposing sections 59 that are mirror images of each other. These sections 59 can be screw-attached separate components, but as illustrated are structures molded integrally into a bottom surface of the seat shell 37, thus saving later assembly costs. The sections 59 each include an elongated depression forming a rack 60 with saw-tooth-shaped protrusions therein configured to mateably engage the teeth 55 on the moldings 39. A rib 61 extends fore-to-aft parallel each of the racks 60 along an outside of each rack 60. The ribs 61 have a protruding ridge 62 (FIG. 17) spaced from the bottom surface 60 that frictionally engages the enlarged end 53 of resilient finger 52 as the seat shell 37 is moved between the lowered position (FIG. 17) and the raised position (FIG. 18) permitting depth adjustment. Upstops or hooks 80 prevent the seat from being raised too far. Thus, finger 52 provides an over-center type detent as it slides over ridge 62, with the finger 52 holding the seat shell 27 selectively in either the raised position or the lowered position. Since the ridge 62 is elongated, the seat shell 37 can be slidably adjusted when in the raised position. Contrastingly, the teeth 55 engage the rack 60 and prevent depth/sliding adjustment when the seat shell 37 is in the lowered position. Further, the seat 33 automatically moves to an interlocked/lowered position when a person sits on the seat 33. It is contemplated that the chair 30 can be constructed without the use of resilient finger 52 and without use of a device to hold the seat in a raised position during adjustment. In such case, the user simply holds the seat up during adjustment.

The fore-to-aft adjustability of the seat shell 37 is limited by engagement of the finger 52 with a structure on the front and rear ends of the depression/rack 60. It is contemplated that the range of depth adjustment can also be controlled by other interfering structures on the seat shell 37 and the top bracket 38. Notably, the seat shell 37 includes a rear end 64 that is relatively smooth, for allowing the seat to slide on the top of top bracket 38 when in the raised position, although it is contemplated that the shell could also be constructed to be slidable on other structure. A pair of hooks 64A on bracket 38 extend through apertures 64B on shell 37 to secure the rear of shell 37 downwardly on bracket 38 and slidably engage slots in the rear of shell 37 such that the rear of shell 37 is retained to the bracket 38, but so that the shell 37 is both pivotable and slidable on the top bracket 38. The front of the seat 33 is retained to the bracket 38 by hook 80 (FIG. 12) that engages a flange of top bracket 38, or is retained by a bottom cover 64C attached to shell 37, the cover 64B engaging a bottom surface of the bracket 38. Other retention means are also contemplated, such as brackets, etc.

Side surfaces on racks 60 slidingly engage the sides of the teeth 55 and finger 52 during depth adjustment of the seat 33. Another pair of ribs 66 and side surfaces 66A (FIG. 10) are located on the bottom of shell 37. The ribs 66 and surfaces 66A act as guides to engage the flange 49 of the top bracket 38 so that the seat 33 does not cock, twist or bind as the seat 33 is slidable adjusted to a desired depth. The hook-shaped member 64A (FIG. 13), rivet, fastener, or other retention device is used at the rear of the seat shell 37 to hold the rear part of the seat shell 37 downwardly on the top bracket 38, but so that the rear of the seat shell 37 is slidable on the top bracket 38.

Figure 3:
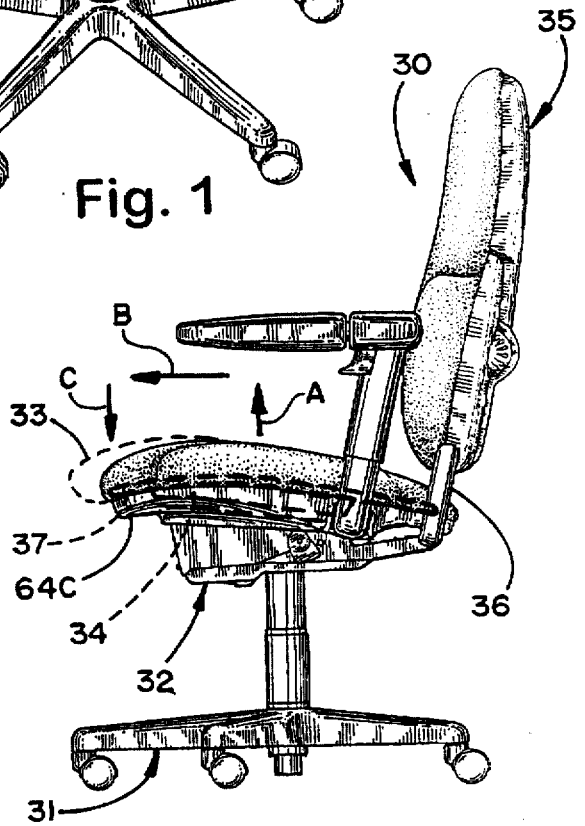

To adjust the seat 33, a user lifts up on the front of the seat 33 in direction A (FIG. 3). As the seat including the seat shell 37 moves upwardly to the raised position (FIG. 14), the finger 52 rides over the ridge 62 such that it holds the seat 33 in the raised position. (Compare the lowered position of FIGS. 15 and 18, and the raised position of FIGS. 16 and 17.) The user can then slide the seat 33 forwardly or rearwardly to a desired depth-adjusted position. During depth adjustment, the seat shell 37 slides on the top of top bracket 38 along direction B and the finger 52 slides along ridge 62. The seat 33 is then locked in an adjusted position by pressing downwardly on the seat 33 or by sitting on the seat. This causes the finger 52 to slide downwardly over the ridge 62 and causes the teeth 55 to engage a portion of rack 60, as the seat moves in direction C.

Figure 20:
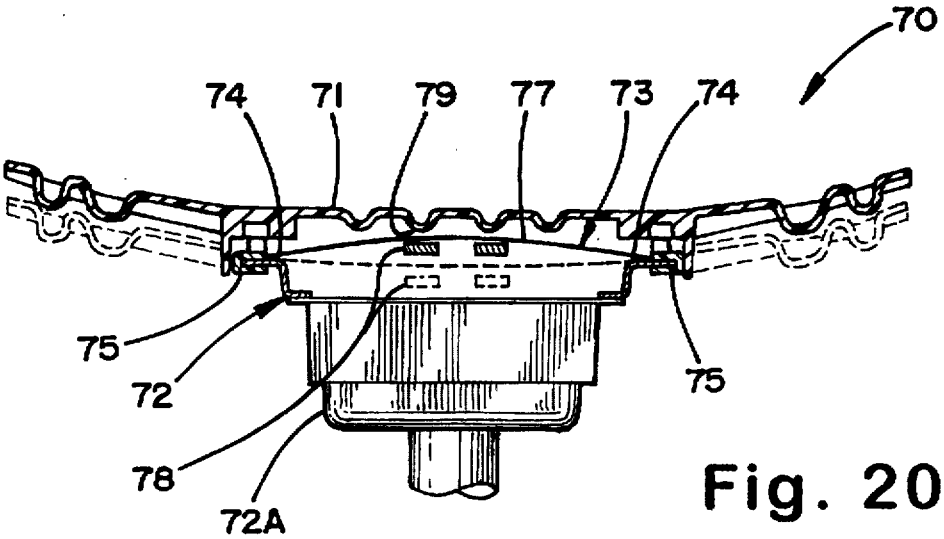
FIG. 20 is a front view of the modified seat construction shown in FIG. 19, the solid lines showing the seat shell in a raised position and the phantom lines showing the seat shell in a lowered position.

A modified chair construction 70 (FIGS. 19 and 20) includes a molded seat shell 71 not unlike seat shell 37. A top bracket 72, not unlike top bracket 38, is attached to the top of a chair control 72A. In the construction 70, the detent device comprises a transverse leaf spring 73 and a structure 78 on the seat shell 37 for capturing the leaf spring 73. Specifically, the leaf spring 73 includes ends 74 snapped loosely laterally into holes in the bracket legs 75, thus providing an easy assembly and thus allowing the spring ends to pivot relative to the bracket legs 75 to facilitate the over-center movement of the leaf spring 73. It is contemplated that other spring attachments are also possible. The body 77 of leaf spring 73 is longer than the space between bracket legs 75 such that the leaf spring 73 either bows upwardly or downwardly in an over-center condition. A pair of spanner members 78 are attached at their ends to the underside of seat shell 71. The spanner members 78 extend fore-to-aft in the chair construction 70, and the bodies of the spanner members 78 define a space 79 between themselves and the bottom of the seat shell 37. The body 77 of leaf spring 73 is located in this space. Thus, when a user lifts on the front of seat shell 71, the spring 73 snaps over-center and holds the seat shell 71 in a raised position where it can be easily adjusted. (See the solid lines in FIG. 20.) When a user presses down on the front of the seat shell 71, the spring 73 snaps over-center and holds the seat shell 71 in an interlocked/adjusted lowered position. (See the dashed lines in FIG. 20.) A dampening material such as felt, fabric, or rubber on the leaf spring 73 prevents the spring from making an unacceptable twang or rattling noise during adjustment of the chair. The sliding depth adjustment of construction 70 is otherwise substantially similar to the chair 30, including the engagement of teeth with a rack for setting the depth adjustment. Thus, this discussion need not be repeated for this modified embodiment.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A chair comprising:

a seat support;

a seat supported on the seat support and constructed for movement thereon between a raised position permitting sliding depth adjustment of the seat relative to the seat support and an interlocked lowered position preventing adjustment; and a detent device on the seat support for securely holding the seat in the raised position while the seat is being slidably adjusted to a desired seat depth.

2. The chair defined in claim 1 including a depth-setting latch comprising at least one tooth on one of the seat and the seat support, and a rack selectively engageable by the at least one tooth on the other one of the seat and the seat support in the interlocked lowered position.

3. The chair defined in claim 2 wherein the seat includes a molded seat shell, and the rack is molded integrally into the seat shell.

4. A chair comprising:

a seat support;

a seat supported on the seat support and constructed for movement thereon between a raised position permitting sliding depth adjustment of the seat relative to the seat support and an interlocked lowered position preventing adjustment; and a device on the seat support for securely holding the seat in the raised position while the seat is being slidably adjusted to a desired seat depth, wherein the device includes a resilient member and the seat includes a seat shell having a configured section adapted to engage the resilient member to hold the seat in the raised position during depth adjustment of the seat.

5. The chair defined in claim 4 wherein the seat shell includes guide structure molded thereon and the seat includes a top bracket configured to engage the guide structure to guide the sliding adjustment of the seat shell on the top bracket in a manner that prevents twisting and binding during depth adjustment of the seat.

6. The chair defined in claim 4 wherein the configured section of the seat shell includes a rib having a detent-forming surface thereon frictionally engaged by the resilient member.

7. The chair defined in claim 6 wherein the resilient member includes a finger with an enlarged end that frictionally engages and slides across the detent-forming surface as the chair seat is pivotally moved between the raised and lowered positions.

8. A chair comprising:

a seat support;

a seat supported on the seat support and constructed for movement thereon between a raised position permitting sliding depth adjustment of the seat relative to the seat support and an interlocked lowered position preventing adjustment; and a device on the seat support for securely holding the seat in the raised position while the seat is being slidably adjusted to a desired seat depth, wherein the device includes a resilient finger, and the seat includes a detent-forming surface for engaging the resilient finger to hold the seat in the raised position during depth adjustment of the seat.

9. A chair comprising:

a seat support;

a seat including a molded seat shell, the seat supported on the seat support and constructed for movement thereon between a raised position permitting sliding depth adjustment of the seat relative to the seat support and an interlocked lowered position preventing adjustment;

a depth-setting latch comprising at least one tooth on one of the seat and the seat support, and a rack integrally molded into the seat shell and selectively engageable by the at least one tooth when the seat is in the interlocked lowered position; and a device on the seat support for securely holding the seat in the raised position while the seat is being slidably adjusted to a desired seat depth, the seat support including a control, a top bracket attached to a top of the control, and a molding attached to the bracket, the molding including the at least one tooth.

10. The chair defined in claim 9 wherein the molding includes a resilient finger, and wherein the seat shell includes detent-forming structure on its bottom for operably engaging the finger, the resilient finger and the detent-forming structure forming a detent device for securely holding the seat in the raised position.

11. The chair defined in claim 10 wherein the top bracket has a pair of parallel legs, and wherein the molding frictionally attaches to one of the legs.

12. A chair comprising:

a seat support;

a seat supported on the seat support and constructed for movement thereon between a raised position permitting sliding depth adjustment of the seat relative to the seat support and an interlocked lowered position preventing adjustment; and a device on the seat support for securely holding the seat in the raised position while the seat is being slidably adjusted to a desired seat depth, wherein the device includes a leaf spring, and the seat includes a leaf-spring-receiving member for operably engaging the leaf spring in an over-center condition to hold the seat selectively in the raised position and in the lowered position.

13. A chair comprising:

a seat;

a control for movably supporting a reclineable chair back;

a bracket attached to the control adapted to slidably support the seat for depth adjustment;

a rack on one of the bracket and the seat, and at least one tooth on the other of the bracket and the seat for selectively engaging the rack when the seat is moved to a lowered position, but permitting depth adjustment of the seat when the seat is in a raised position; and a device separate from the rack and tooth and located on one of the seat and the bracket that selectively holds the at least one tooth and the rack in a spaced-apart, disengaged relationship when the seat is in the raised position.

14. The chair defined in claim 13 wherein the device on one of the seat and the bracket comprises a detent device for holding the seat in the raised position while the seat is being slidably adjusted to a desired seat depth.

15. The chair defined in claim 13, wherein the rack defines a plurality of teeth, each having a relatively sharp edge, the at least one tooth defining a relatively sharp edge that meshes with selected ones of the teeth of the rack such that the at least one tooth is always engageable with the teeth even when in an intermediate position between two adjacent ones of the teeth.

16. A chair comprising:

a base including a control;

a seat support bracket attached to the control and including parallel opposing members having a forward end and a rearward end;

moldings attached to each of the opposing members generally at the forward ends of the opposing members, at least one of the moldings including a resilient finger and a rack; and a seat including a seat shell with teeth constructed to selectively engage the racks of the molding to selectively hold the seat shell in different seat-depth-adjusted positions, the seat shell further having a ridge spaced from the teeth constructed to slidably engage the resilient finger when the teeth are disengaged from the molding for continuously holding the seat shell in a raised teeth-disengaged position so that the seat shell is easily adjustable; the seat shell and the seat support bracket further having mating structures that slidably engage and act as guides to prevent twisting and binding of the seat shell during depth adjustment of the seat.

17. A chair comprising:

a seat including a molded shell;

a control for movably supporting a reclineable chair back;

a bracket attached to the control adapted to slidably support the seat for depth adjustment; and a rack on one of the bracket and the molded shell, and teeth on the other of the bracket and the molded shell for selectively engaging the rack when the seat is moved to a lowered position, but permitting depth adjustment of the seat when the seat is in a raised position;

a device on one of the seat shell and the bracket for holding the seat in the raised position while the seat is being slidably adjusted to a desired seat depth;

wherein the device includes a resilient frictional member on the bracket and mating structure on the seat shell, the resilient frictional member being movable across the mating structure and frictionally engaged therewith to selectively hold the seat in the raised position or in the lowered position.

18. The chair defined in claim 17 wherein the bracket includes a molding, and wherein the resilient frictional member is a spring finger integrally molded into the molding.

19. The chair defined in claim 18 wherein the bracket includes a metal component attached to the control, and wherein the molding is configured to frictionally attach to the metal component.

20. A chair comprising:

a seat including a molded shell;

a control for movably supporting a reclineable chair back:

a bracket attached to the control adapted to slidably support the seat for depth adjustment: and a rack on one of the bracket and the molded shell, and teeth on the other of the bracket and the molded shell for selectively engaging the rack when the seat is moved to a lowered position, but permitting depth adjustment of the seat when the seat is in a raised position;

wherein the molded shell includes guide structure molded thereon that is configured to engage mating structure on the bracket to guide the sliding adjustment of the seat shell on the bracket in a manner that prevents twisting and binding during depth adjustment of the seat.

* * * * *